US006514046B1

(12) United States Patent
Morrison et al.

(10) Patent No.: US 6,514,046 B1
(45) Date of Patent: Feb. 4, 2003

(54) CERAMIC COMPOSITE VANE WITH METALLIC SUBSTRUCTURE

(75) Inventors: Jay A. Morrison, Oviedo, FL (US); Gary B. Merrill, Monroeville, PA (US); Jay E. Lane, Murrysville, PA (US); Christian X. Campbell, Orlando, FL (US); Daniel G. Thompson, Pittsburgh, PA (US); Eric V. Carelli, Greensburg, PA (US); Christine Taut, Essen (DE)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/677,044

(22) Filed: Sep. 29, 2000

(51) Int. Cl.[7] ..... F01D 5/18
(52) U.S. Cl. ..... 416/229 A; 416/241 B
(58) Field of Search ..... 416/97 R, 96 A, 416/229 A, 241 B; 415/209, 210, 191, 115, 200

(56) References Cited

U.S. PATENT DOCUMENTS 4,376,004 A * 3/1983 Bratton et al. ..... 416/241 B
4,396,349 A * 8/1983 Hueber ..... 416/115
4,519,745 A * 5/1985 Rosman et al. ..... 416/241 B
4,563,128 A 1/1986 Rossmann
4,629,397 A * 12/1986 Schweitzer ..... 415/115
4,645,421 A 2/1987 Huether
4,790,721 A 12/1988 Morris et al.
4,838,031 A 6/1989 Cramer
5,358,379 A 10/1994 Pepperman et al.
5,516,260 A * 5/1996 Damlis et al. ..... 415/115
6,013,592 A * 1/2000 Merrill et al. ..... 501/80
6,283,708 B1 * 9/2001 Zelesky ..... 416/97 R
6,284,390 B1 * 9/2001 Bose et al. ..... 416/241 R
6,291,084 B1 * 9/2001 Darolia et al. ..... 416/241 R

* cited by examiner

*Primary Examiner*—Edward K. Look
*Assistant Examiner*—Igor Kershteyn

(57) ABSTRACT

A vane assembly for a turbine assembly includes an inner endcap, an outer endcap, and a body. The body includes a metallic core assembly, a ceramic shell assembly and a support assembly. The metallic core assembly is coupled to the inner and outer endcaps and bears most of the mechanical loads, including aerodynamic loads. The ceramic shell bears substantially all of the thermal stress placed on the vane assembly. The support assembly is disposed between the metallic core assembly and said ceramic shell assembly and is coupled to the metallic core assembly.

54 Claims, 6 Drawing Sheets

CERAMIC COMPOSITE VANE WITH METALLIC SUBSTRUCTURE

BACKGROUND OF THE INVENTION

1. Field of the Invention

This invention relates to the vanes of a turbine assembly and, more specifically, to a ceramic composite vane having a metallic substructure.

2. Background Information

Combustion turbine power plants, generally, have three main assemblies: a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C.). The working gas is expanded through the turbine assembly. The turbine assembly includes a plurality of stationary vane assemblies and rotating blades. The rotating blades are coupled to a central shaft. The expansion of the working gas through the turbine assembly forces the blades to rotate creating a rotation in the shaft.

Typically, the turbine assembly provides a means of cooling the vane assemblies. The first row of vane assemblies, which typically precedes the first row of blades in the turbine assembly, is subject to the highest temperature of working gas. To cool the first row of vane assemblies, a coolant, such as steam or compressed air, is passed through passageways formed within the vane structure. These passageways often include an opening along the trailing edge of the vane to allow the coolant to join the working gas.

The cooling requirements for a vane assembly can be substantially reduced by providing the vane assembly with a ceramic shell as its outermost surface. Ceramic materials, as compared to metallic materials, are less subject to degrading when exposed to high temperatures. Ceramic structures having an extended length, such as vanes associated with large, land based turbines, are less able to sustain the high mechanical loads or deformations incurred during the normal operation of a turbine vane. As such, it is desirable to have a turbine vane that incorporates a metallic substructure, which is able to resist the mechanical loads on the vane, and a ceramic shell, which is able to resist high thermal conditions.

Prior art ceramic vane structures included vanes constructed entirely of ceramic materials. These vanes were, however, less capable of handling the mechanical loads typically placed on turbine vanes and had a reduced length. Other ceramic vanes included a ceramic coating which was bonded to a thermal insulation disposed around a metallic substructure. Such a ceramic coating does not provide any significant structural support. Additionally, the bonding of the ceramic coating to the thermal insulation precludes the use of a composite ceramic. Additionally, because the ceramic was bonded to the insulating material, the ceramic could not be cooled in the conventional manner, i.e., passing a fluid through the vane assembly. The feltmetal typically has a lower tolerance to high temperature than the metallic substructure, thus additional cooling was required.

Alternative ceramic shell/metallic substructure vanes include vanes having a ceramic leading edge and a metallic vane body, and a rotating blade having a metallic substructure and a ceramic shell having a corrugated metal partition therebetween. These structures require additional assembly steps during the final assembly of the vane or blade which are time-consuming and require a rotational force to activate certain internal seals.

There is, therefore, a need for a composite ceramic vane assembly for a turbine assembly having a metallic core assembly with attached support structures and a ceramic shell assembly.

There is a further need for a composite ceramic vane assembly having a ceramic shell assembly which is structured to be cooled by the cooling system for the vane assembly.

There is a further need for a composite ceramic vane assembly which transmits the aerodynamic forces of the ceramic shell assembly to the metallic core assembly without imparting undue stress to the ceramic shell assembly.

There is a further need for a composite ceramic vane assembly which accommodates differential thermal expansion rates between the ceramic shell assembly and the metallic core assembly while maintaining a positive pre-load on the ceramic shell assembly.

SUMMARY OF THE INVENTION

These needs, and others, are satisfied by the invention which provides a turbine vane assembly having a ceramic shell assembly and a metallic core assembly. The metallic core assembly includes an attached support assembly. The metallic core assembly includes passages for a cooling fluid to pass therethrough. The support assembly is structured to transmit the aerodynamic forces of the ceramic shell assembly to the metallic core assembly without imparting undue stress to the ceramic shell assembly. The support assembly can be any one of, or a combination of, a compliant layer, such as a feltmetal, contact points, such as a raised ribs or dimples on the metallic core assembly, or a biasing means, such as a leaf spring.

The metallic core assembly includes at least one cooling passage therethrough. The ceramic shell assembly has an exterior surface, which is exposed to the working gas, and an interior surface. The ceramic shell assembly interior surface is in fluid communication with the metallic core assembly cooling passage. For example, if the ceramic shell assembly is supported by ribs on the metallic core assembly, a cooling fluid may pass between adjacent ribs. If the ceramic shell assembly is supported by a biasing means, the cooling fluid may be passed over the biasing means. If the ceramic shell assembly is supported by a compliant layer, the compliant layer may have cooling passages formed therein.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS

Figure 1:
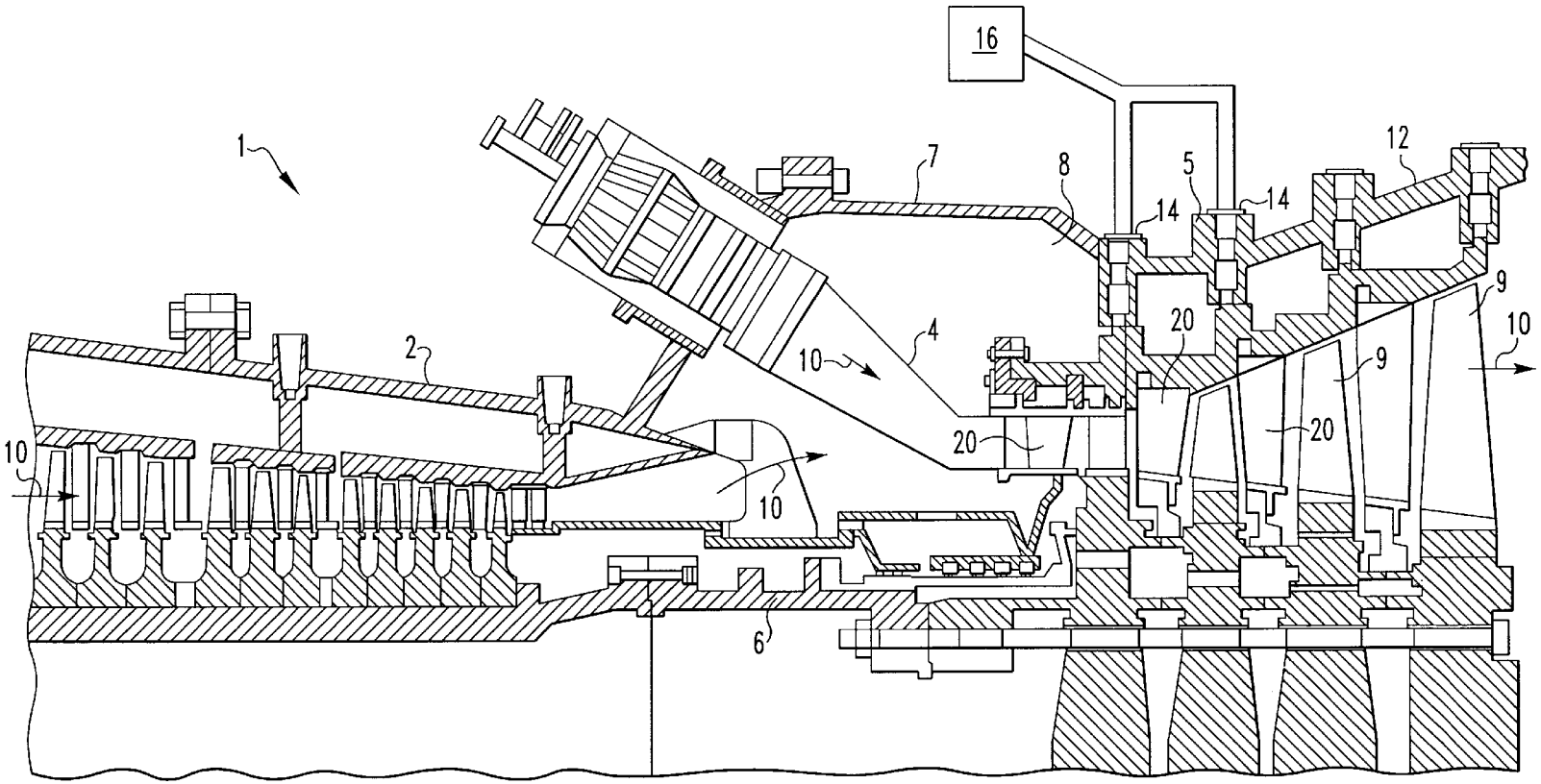
FIG. 1 is a cross sectional view of a compressor turbine power plant.

As is well known in the art and shown in FIG. 1, a combustion turbine 1 includes a compressor assembly 2, at least one combustor assembly 3, a transition section 4, and a turbine assembly 5. A flow path 10 exists through the compressor assembly 2, combustor assembly 3, transition section 4, and turbine assembly 5. The turbine assembly 5 is mechanically coupled to the compressor assembly 2 by a central shaft 6. Typically, an outer casing 7 encloses a plurality of combustor assemblies 3 and transition sections 4. The outer casing 7 creates a compressed air plenum 8. The combustor assemblies 3 and transition sections 4 are disposed within the compressed air plenum 8. The combustor assemblies 3 are disposed circumferentiality about the central shaft 6.

In operation, the compressor assembly 2 inducts ambient air and compresses it. The compressed air travels through the flow path 10 to the compressed air plenum 8 defined by the casing 7. Compressed air within the compressed air plenum 8 enters a combustor assembly 3 where the compressed air is mixed with a fuel and ignited to create a working gas. The heated working gas is typically at a temperature of between 2500 to 2900° F. (1371 to 1593° C.). The working gas passes from the combustor assembly 3 through the transition section 4 into the turbine assembly 5. In the turbine assembly 5 the working gas is expanded through a series of rotatable blades 9, which are attached to the shaft 6, and a plurality of stationary ceramic vane assemblies 20. As the working gas passes through the turbine assembly 5, the blades 9 and shaft 6 rotate creating mechanical force. The turbine assembly 5 can be coupled to a generator to produce electricity.

The ceramic vane assemblies 20, especially those adjacent to the transition sections 4, are exposed to the high temperature working gas. To reduce thermal degradation of the vane assemblies 20, the turbine assembly includes a casing 12 having cooling passages 14 therethrough. The casing cooling passages 14 are coupled to a cooling system 16, such as an air or steam system. The casing cooling passages 14 are coupled to vane assembly main cooling passages 36 (described below).

Figure 2:
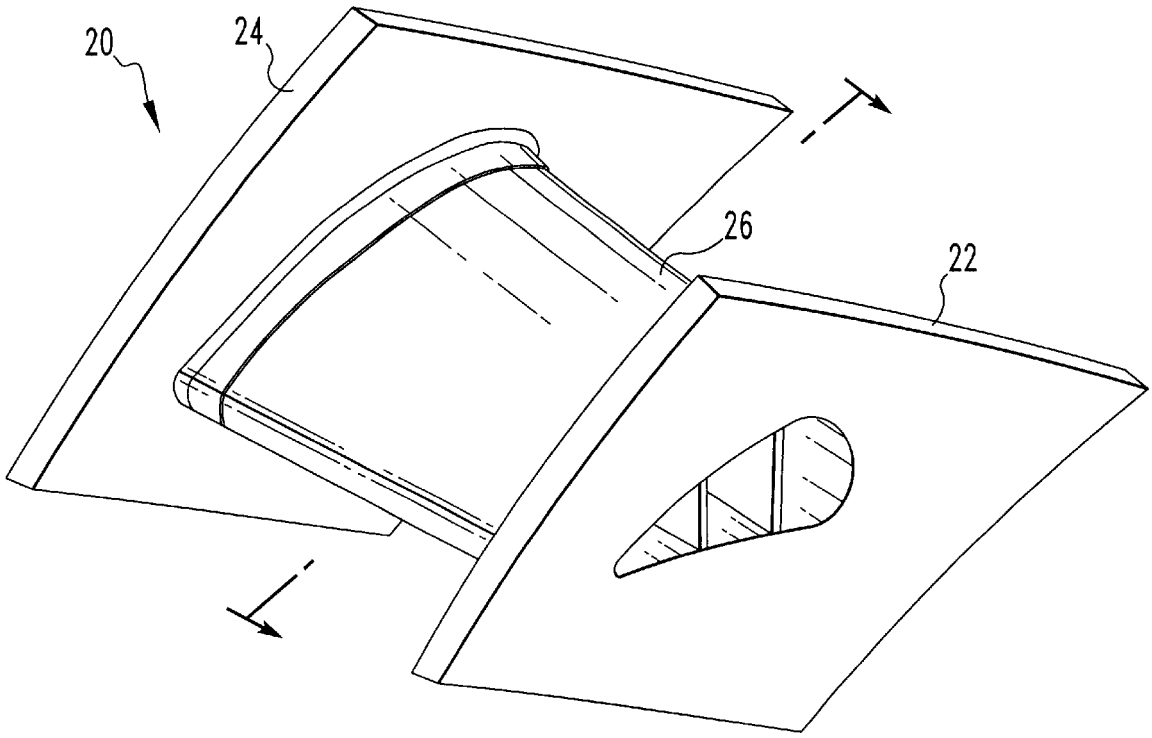
FIG. 2 is an isometric view of a vane assembly.
Figure 3:
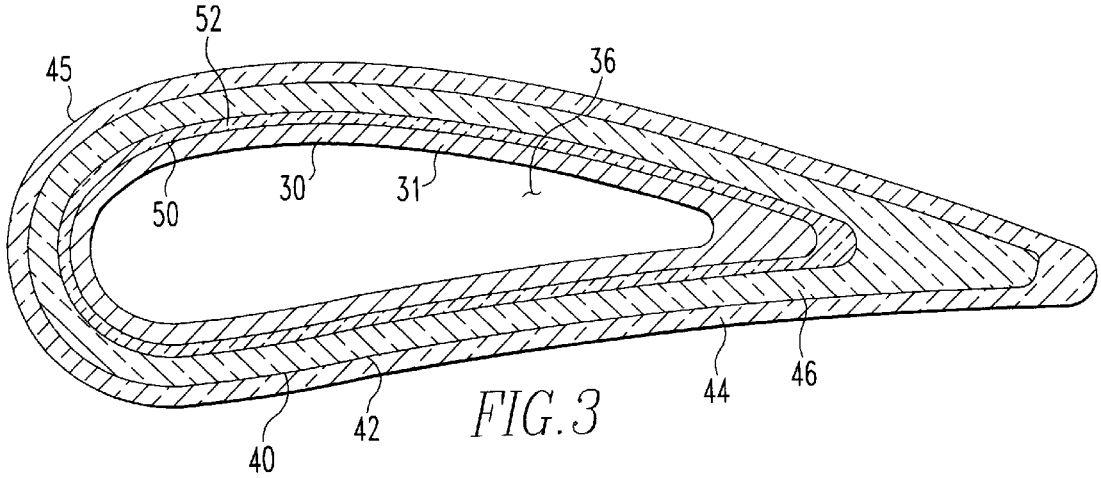
FIG. 3 is a cross-sectional view of a metallic core assembly, ceramic shell assembly, and support assembly comprising a layer of feltmetal.
Figure 4:
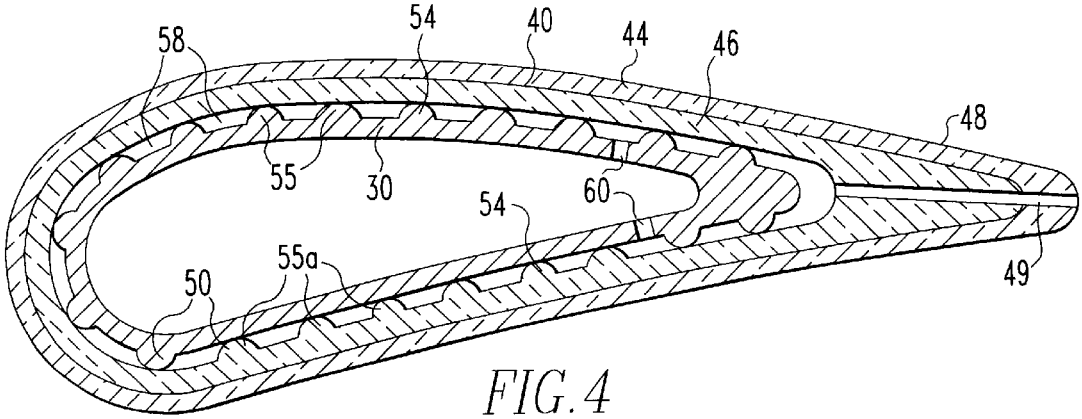
FIG. 4 is a cross-sectional view of a metallic core assembly, ceramic shell assembly, and a support assembly comprising a plurality of contact points.
Figure 5:
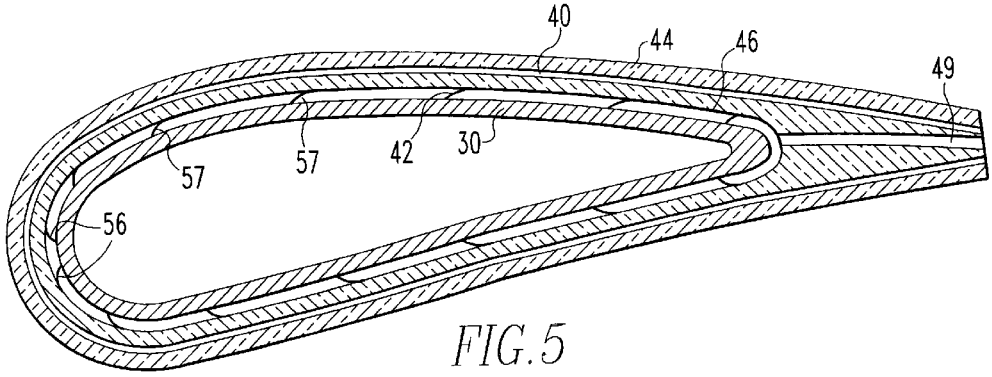
FIG. 5 is a cross-sectional view of a metallic core assembly, ceramic shell assembly, and a support assembly comprising a biasing means such as leaf springs.
Figure 6:
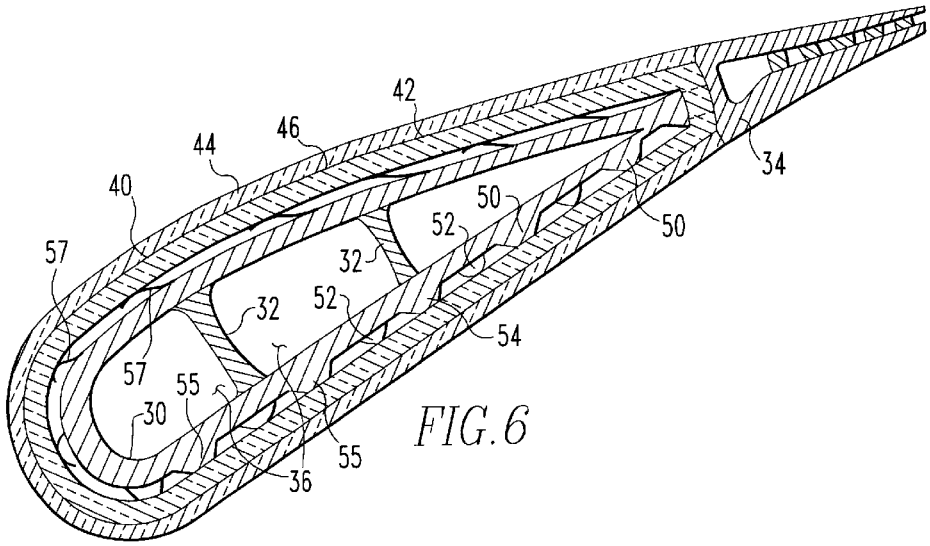
FIG. 6 is a cross-sectional view of a metallic core assembly, ceramic shell assembly, and a support assembly comprising a layer of feltmetal, a plurality of contact points, and a biasing means.

As shown in FIG. 2, the vane assemblies 20 have an inner endcap 22, an outer endcap 24 and a body 26. The end caps 22, 24 are structured to be coupled to casing 12. The body 26 is preferably an airfoil which, in operation, will have a high pressure side and a low pressure side. As shown in FIG. 3, the body 26 includes a metallic core assembly 30, a ceramic shell assembly 40, and a support assembly 50. As shown in FIG. 3, the support assembly 50 is a compliant layer 52, as will be described below. As shown in FIGS. 4 and 5, respectively, the support assembly 50 may also be a plurality of hard contact points 54 or a biasing means 56, both described below. As shown in FIG. 6, the support assembly 50 may also be a combination of two or more of a compliant layer 52, a plurality of hard contact points 54, or a biasing means 56.

As shown in FIG. 3, the metallic core assembly 30 includes a frame 31. The metallic core assembly 30 is coupled to, including being integral with, the inner endcap 22 and/or outer endcap 24. As such, the metallic core assembly 30 bears almost all mechanical loading, including aerodynamic loading, during operation. The frame 31 of the metallic core assembly 30 form at least one main cooling passage 36 that extend between the outer endcap 24 and the inner endcap 22. The main cooling passages 36 are in fluid communication with the cooling system 16. As shown in FIG. 6, the metallic core assembly 30 may also include at least one, and possibly two or more, spars 32, and a metallic trailing edge assembly 34. If a spar 32 is used, the metallic core assembly forms at least two cooling passages 36.

As shown on FIG. 3, the ceramic shell assembly 40 includes at least one layer, and preferably two layers, of a ceramic material 42. The ceramic layer 42 is not bonded or fixed to the metallic core assembly 30. The ceramic material 42, as will be described below, is supported on the metallic core assembly 30 by the support assembly 50. The ceramic layer may also extend over the end caps 22, 24. When there are more than one ceramic layers 42, it is preferable to have an outer layer 44 and an inner layer 46. The inner layer 46 is preferably a strain tolerant continuous fiber reinforced ceramic composite matrix which can deform to accommodate slight manufacturing tolerance mismatches and distortions due to loading such as AS-N720, A-N720, AS-N610, or A-N610 from COI Ceramics, 9617 Distribution Avenue, San Diego, Calif., 92121. The outer layer 44 may be a monolithic ceramic. The outer layer 44 is, however, preferably a high temperature insulating ceramic. The outer layer may have an outer coating such as a conventional environmental coating or thermal barrier 45.

The ceramic shell assembly 40 is supported on the metallic core assembly 30 by the support assembly 50. The support assembly 50 is coupled to, including being integral with, the metallic core assembly 30. The support assembly 50 may include one or more of the following support members: a compliant layer 52, a plurality of hard contact points 54, or a biasing means 56. As shown in FIG. 3, the compliant layer 52 may be in the form of a continuous layer of material between the metallic core assembly 30 and the ceramic shell assembly 40. Alternatively, as shown in FIG. 6, compliant strips may be placed between hard contact points 54 (described below). Of course, any combination of a semi-continuous layer and strips may also be used. When a continuous compliant layer 52 is used, passages 53 (See FIG. 7) may be formed therein to allow cooling fluid to reach the ceramic shell assembly 40 (described below). The compliant layer passages 53 are in fluid communication with the main cooling passages 36 of the metallic core assembly 30. Alternatively, the compliant layer 52 may have a sufficiently porous consistency to allow a cooling fluid to pass therethrough to contact the ceramic shell assembly 40.

The compliant layer 52 is preferably a feltmetal, such as Hastelloy-X material FM528A, FM515B, FM509D, Haynes 188 material FM21B, FM522A, or FeCrAlY material FM542, FM543, FM544, all from Technetics Corporation, 1600 Industrial Drive, DeLand, Fla. 32724-2095. When the compliant layer 52 is a feltmetal, the feltmetal may be bonded or brazed to the metallic core assembly 30. The compliant layer 52 may also be a porous metallic foam, such as open cell foam made by Doucel ® Foams made by ERG, 900 Stanford, Calif., 94608 or closed cell foam made from hollow metal powders.

As used herein, a "hard contact point" may still be somewhat compliant. As shown on FIG. 4, The hard contact points 54 are, preferably, raised ribs 55 which extend over the length of the body 26. The hard contact points may be raised dimples as well. The ribs 55 may be formed integrally with the metallic core assembly 30 extending toward the ceramic shell assembly 40, or the ribs 55*a* may be integral with the inner layer 46 and extend toward the metallic core assembly 30. When the hard contact points 54 are formed as part of the ceramic shell assembly 40, the ribs aid in heat transfer thereby increasing the effectiveness of the cooling system 16. The hard contact points 54 are generally located on the high pressure side of the airfoil shaped body 26. Between the ribs 55 are interstices 58. The interstices 58 are in fluid communication with the main cooling passages 36. As described above, strips of a compliant layer 52 may be disposed in the interstices 58.

A vane assembly 20 having a biasing means 56 for a support structure 50 is shown in FIG. 5. The biasing means 56 is preferably a plurality of leaf springs 57, however, any type of spring may be used. The biasing means 56 maintains a supporting force on the ceramic shell assembly 40. This supporting force also accommodates the differential thermal expansion between the metallic core assembly 30 and the ceramic shell assembly 40. The biasing means 56 preferably interacts with the low pressure side of the body 26. A cooling fluid may flow in and around the structure of the biasing means 56 and be in fluid communication with the ceramic shell assembly 40.

Figure 7:
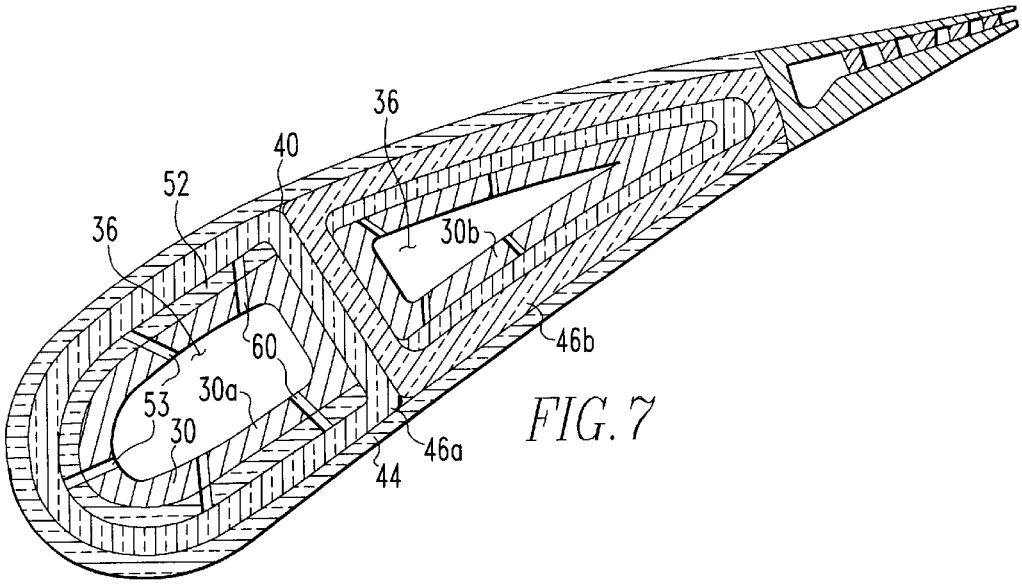
FIG. 7 is a view of an alternate embodiment.

The combination of the metallic core assembly 30, ceramic shell assembly 40 and support assembly 50, may be structured in many configurations. As shown in FIG. 4, the ceramic shell assembly 40 may include a trailing edge portion 48 of the body 26. As with the metallic trailing edge assembly 34, the ceramic trailing edge portion 48 may include cooling passages 49 which are in fluid communication with the cooling system 16 via openings 60. Another alternate design is shown in FIG. 7. This embodiment includes a two piece metallic core assembly 30*a,* 30*b,* a ceramic shell assembly 40 having a two piece inner layer 46*a,* 46*b* and a one piece outer layer 44, and a compliant layer 52 disposed between metallic core assembly 30*a,* 30*b* and the two piece inner layer 46*a,* 46*b*. FIG. 7 further shows a plurality of connecting passages 60 which are in fluid communication with the main passages 36 and the compliant layer 52.

Figure 8:
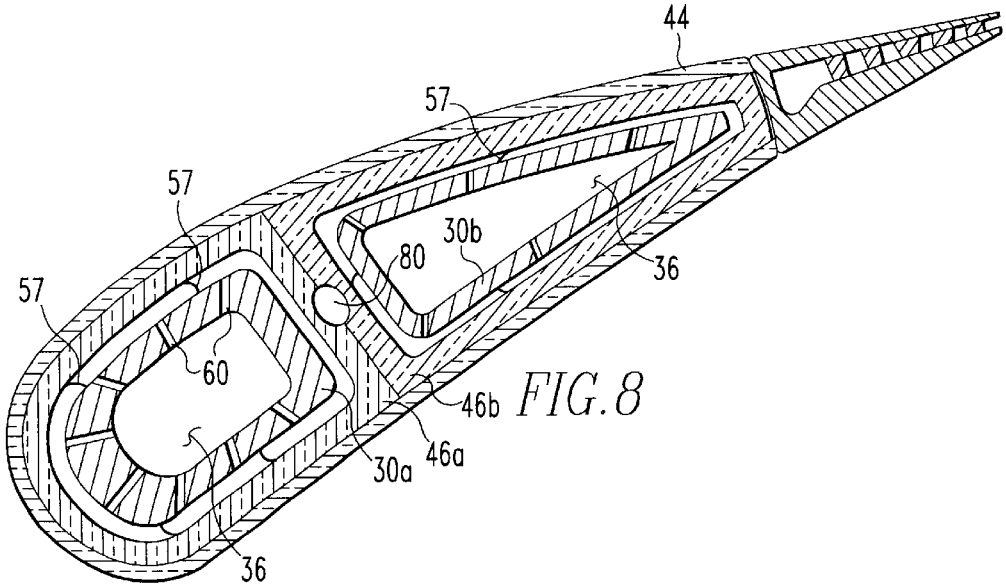
FIG. 8 is a view of an alternate embodiment.
Figure 9:
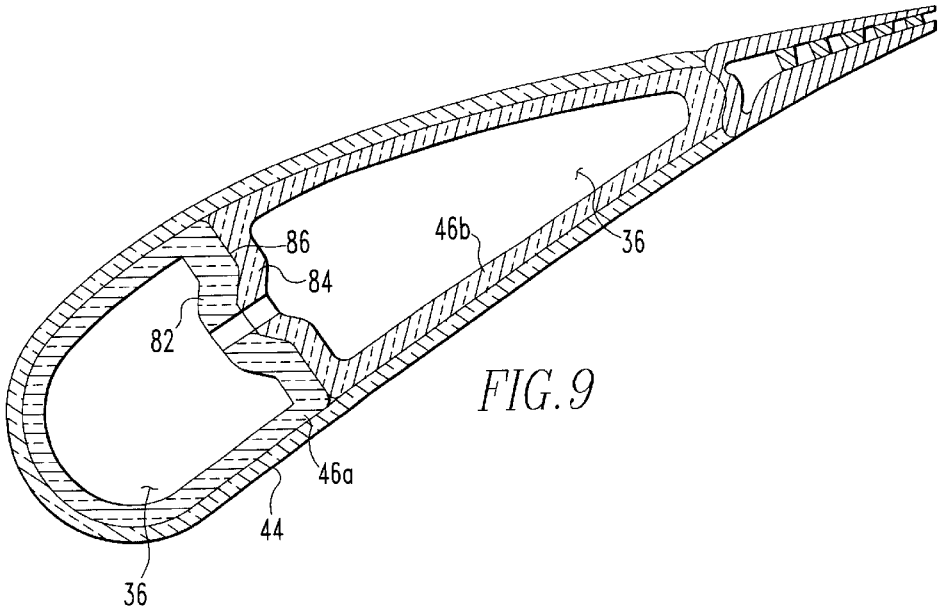
FIG. 9 is a view of an alternate embodiment.

FIG. 8 shows another alternate embodiment. As before, this embodiment includes a two piece metallic core assembly 30*a,* 30*b,* and a ceramic shell assembly 40 having a two piece inner layer 46*a,* 46*b* and a one piece outer layer 44. The support assembly 50 is a plurality of leaf springs 57. Again the metallic core assembly 30 includes a plurality of connecting passages 60 that permit fluid communication between the main passages 36 and the support assembly 50. A support pin 80 extending between the endcaps 22, 24, may be used to reduce the movement between the inner layer portions 46*a,* 46*b*. Alternatively, as shown in FIG. 9, the inner layer portions 46*a,* 46*b* may include deflections 82, 84 along an interface 86 to reduce the movement between the inner layer portions 46*a,* 46*b*.

Figure 10:
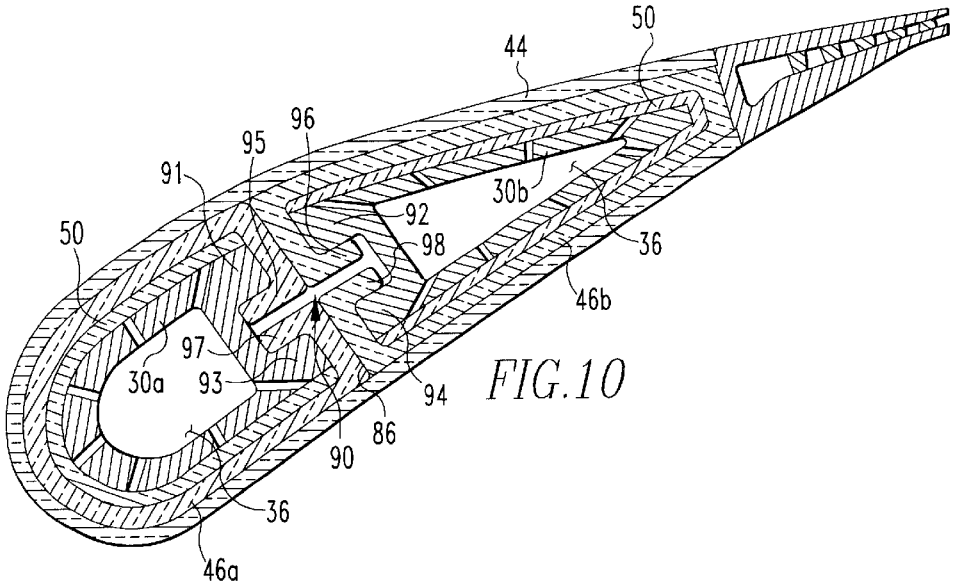
FIG. 10 is a view of an alternate embodiment.

As shown in FIG. 10, the metallic core assembly 30 and ceramic shell assembly 40 may include a structural lock 90 formed by the metallic core assembly 30 and the inner layer 46*a,* 46*b*. The structural lock 90 includes tabs 91, 92, 93, and 94, which extend toward the interface 86 between the inner layer portions 46*a,* 46*b*. The inner layer portions 46*a,* 46*b* include tabs 95, 96, 97, and 98 which are structured to extend around tabs 91, 92, 93, and 94 respectively.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended hereto and any and all equivalents thereof.

What is claimed is:

1. A vane assembly for a turbine assembly comprising:

an inner endcap;

an outer endcap;

a body:

said body comprises:

a metallic core assembly which is coupled to said inner endcap and said outer endcap;

a ceramic shell assembly;

a support assembly coupled to said metallic core assembly; and said support assembly being disposed between said metallic core assembly and said ceramic shell assembly and adapted to transmit substantially all aerodynamic loads from said shell assembly to said core assembly during operation.

2. The vane assembly of claim 1, wherein said support assembly is one or more of the structures selected from the group consisting of: a compliant layer, hard contact points and a biasing means.

3. The vane assembly of claim 2, wherein said ceramic shell assembly comprises an inner layer of ceramic material and an outer layer of ceramic material.

4. The vane assembly of claim 3, wherein said inner layer is a ceramic matrix composite.

5. The vane assembly of claim 4, wherein:

said metallic core assembly comprises a frame forming at least one main cooling passage.

6. The vane assembly of claim 5, wherein:

said frame includes a plurality of connecting passages that are in fluid communication with both said at least one main passage and said support assembly.

7. The vane assembly of claim 6, wherein:

said support assembly hard contact points includes a plurality of ribs; and said support assembly includes a plurality of strips of a compliant material disposed between said ribs.

8. The vane assembly of claim 3, wherein said biasing means is a plurality of leaf springs.

9. The vane assembly of claim 8, wherein:

said body has a high pressure side and a low pressure side; and said plurality of leaf springs is disposed between said metallic core assembly and said ceramic shell assembly adjacent to said low pressure side and a plurality of ribs is disposed between said metallic core assembly and said ceramic shell assembly adjacent to said high pressure side.

10. The vane assembly of claim 3, wherein said outer layer is an insulating ceramic.

11. The vane assembly of claim 10, wherein said outer layer is ceramic insulation comprising hollow ceramic spheres.

12. A vane assembly for a turbine assembly comprising:

an inner endcap;

an outer endcap;

a body:

said body comprises:

a metallic core assembly which is coupled to said inner endcap and said outer endcap;

a ceramic shell assembly;

a support assembly coupled to said metallic core assembly; and said support assembly being a layer of a compliant material, wherein said compliant material includes a plurality of cooling passages therethrough being in fluid communication with said ceramic shell assembly.

13. The vane assembly of claim 12, wherein said ceramic shell assembly comprises an inner layer of ceramic material and an outer layer of ceramic material.

14. The vane assembly of claim 13, wherein said inner layer is a ceramic matrix composite.

15. The vane assembly of claim 14, wherein said outer layer is an insulating ceramic.

16. The vane assembly of claim 15, wherein said outer layer is ceramic insulation comprising hollow ceramic spheres.

17. The vane assembly of claim 14, wherein said metallic core assembly comprises a frame forming at least one main cooling passage.

18. The vane assembly of claim 17, wherein said frame assembly includes a plurality of connecting passages that are in fluid communication with both said at least one main cooling passage and said support assembly.

19. The vane assembly of claim 1, wherein said support assembly is a plurality of leaf springs.

20. The vane assembly of claim 19, wherein said ceramic shell assembly comprises an inner layer of ceramic material and an outer layer of ceramic material.

21. The vane assembly of claim 20, wherein said inner layer is a ceramic matrix composite.

22. The vane assembly of claim 21, wherein said outer layer is an insulating ceramic.

23. The vane assembly of claim 22, wherein said outer layer is ceramic insulation comprising hollow ceramic spheres.

24. The vane assembly of claim 23, wherein:

said metallic core assembly comprises a frame forming at least one main cooling passage.

25. The vane assembly of claim 24, wherein:

said frame assembly includes a plurality of connecting passages that are in fluid communication with both said at least one main cooling passage and said support assembly.

26. The vane assembly of claim 1 wherein said support assembly comprises a plurality of hard contact points and wherein said plurality hard contact points include a plurality of ribs extending from said ceramic shell assembly towards said metallic core assembly.

27. A turbine comprising:

a casing;

a cooling system; and a plurality of vane assemblies comprising:
an inner endcap;
an outer endcap;
a body:

said body comprises:

a metallic core assembly which is coupled to said inner endcap and said outer endcap;

a ceramic shell assembly;

a support assembly coupled to said metallic core assembly; and said support assembly being disposed between said metallic core assembly and said ceramic shell assembly and adapted to transmit substantially all aerodynamic loads from said shell assembly to said core assembly during operation.

28. The turbine of claim 27, wherein said support assembly is one or more of the structures selected from the group consisting of: a compliant layer, hard contact points and a biasing means.

29. The turbine of claim 28, wherein said ceramic shell assembly comprises an inner layer of ceramic material and an outer layer of ceramic material.

30. The turbine of claim 29, wherein said inner layer is a ceramic matrix composite.

31. The turbine of claim 29, wherein said outer layer is an insulating ceramic.

32. The turbine of claim 31, wherein said outer layer is ceramic insulation comprising hollow ceramic spheres.

33. The turbine of claim 31, wherein:

said metallic core assembly comprises a frame forming at least one main cooling passage.

34. The turbine of claim 33, wherein:

said frame includes a plurality of connecting passages that are in fluid communication with both said at least one main passage and said support assembly.

35. The turbine of claim 34, wherein:

said support assembly hard contact points includes a plurality of ribs; and said support assembly includes a plurality of strips of a compliant material disposed between said ribs.

36. The turbine of claim 29, wherein said biasing means is a plurality of leaf springs.

37. The turbine of claim 36, wherein:

said body has a high pressure side and a low pressure side; and said plurality of leaf springs is disposed between said metallic core assembly and said ceramic shell assembly adjacent to said low pressure side and a plurality of ribs is disposed between said metallic core assembly and said ceramic shell assembly adjacent to said high pressure side.

38. The turbine of claim 28, wherein said support assembly is a layer of a compliant material.

39. A turbine comprising:

a casing;

a cooling system; and a plurality of vane assemblies comprising:
an inner endcap;
an outer endcap;
a body:

said body comprises:

a metallic core assembly which is coupled to said inner endcap and said outer endcap;

a ceramic shell assembly;

a support assembly coupled to said metallic core assembly; and said support assembly disposed between said metallic core assembly and said ceramic shell assembly, wherein said support assembly is a layer of a compliant material, wherein said compliant material includes a plurality of cooling passages therethrough being in fluid communication with said ceramic shell assembly.

40. The turbine of claim 39, wherein said ceramic shell assembly comprises an inner layer of ceramic material and an outer layer of ceramic material.

41. The turbine of claim 40, wherein said inner layer is a ceramic matrix composite.

42. The turbine of claim 41, wherein said outer layer is an insulating ceramic.

43. The turbine of claim 42, wherein said outer layer is ceramic insulation comprising hollow ceramic spheres.

44. The turbine of claim 41, wherein said metallic core assembly comprises a frame forming at least one main cooling passage.

45. The turbine of claim 44, wherein said frame assembly includes a plurality of connecting passages that are in fluid communication with both said at least one main cooling passage and said support assembly.

46. The turbine of claim 27, wherein said support assembly is a plurality of leaf springs.

47. The turbine of claim 46, wherein said ceramic shell assembly comprises an inner layer of ceramic material and an outer layer of ceramic material.

48. The turbine of claim 47, wherein said inner layer is a ceramic matrix composite.

49. The turbine of claim 48, wherein said outer layer is an insulating ceramic.

50. The turbine of claim 49, wherein said outer layer is ceramic insulation comprising hollow ceramic spheres.

51. The turbine of claim 50, wherein:

said metallic core assembly comprises a frame forming at least one main cooling passage.

52. The turbine of claim 51, wherein:

said frame assembly includes a plurality of connecting passages that are in fluid communication with both said at least one main cooling passage and said support assembly.

53. A turbine assembly comprising:

a casing;

a cooling system; and a plurality of vane assemblies comprising:

an inner endcap;

an outer endcap;

a body:

said body comprises:

a metallic core assembly which is coupled to said inner endcap and said outer endcap;

a ceramic shell assembly;

a support assembly coupled to said ceramic shell assembly;

said support assembly being disposed between said metallic core assembly and said ceramic shell assembly and adapted to transmit substantially all aerodynamic loads from said shell assembly to said core assembly during operation; and said support assembly comprises a plurality of hard contact points.

54. The turbine assembly of claim 53 wherein said plurality hard contact points include a plurality of ribs extending from said ceramic shell assembly towards said metallic core assembly.

* * * * *